US012220098B1

(12) United States Patent
Wang

(10) Patent No.: US 12,220,098 B1
(45) Date of Patent: Feb. 11, 2025

(54) CONTAINER WASHING DEVICE

(71) Applicant: Ming Wang, Chizhou (CN)

(72) Inventor: Ming Wang, Chizhou (CN)

( * ) Notice: Subject to any disclaimer, the term of this patent is extended or adjusted under 35 U.S.C. 154(b) by 0 days.

(21) Appl. No.: 18/586,553

(22) Filed: Feb. 26, 2024

(30) Foreign Application Priority Data

Feb. 6, 2024 (CN) ..... 202420289084.4

(51) Int. Cl.
*A47L 15/00* (2006.01)
*A47L 15/42* (2006.01)

(52) U.S. Cl.
CPC ..... *A47L 15/0068* (2013.01); *A47L 15/4214* (2013.01)

(58) Field of Classification Search
None
See application file for complete search history.

(56) References Cited

U.S. PATENT DOCUMENTS

| | | | |
|---|---|---|---|
| 11,779,188 | B1 | 10/2023 | Chen |
| 2014/0013529 | A1 | 1/2014 | Kilgore et al. |
| 2017/0265714 | A1 | 9/2017 | Canales |
| 2022/0339678 | A1 | 10/2022 | Ding |

*Primary Examiner* — Levon J Shahinian
(74) *Attorney, Agent, or Firm* — George D. Morgan

(57) ABSTRACT

The present disclosure relates to the technical field of a container scrubbing device, including a connecting sleeve, The connecting sleeve has a first end part; the scrubbing rod is connected to the first end part, and a first scrubbing piece is arranged at a top side and/or a peripheral side of the scrubbing rod; the guide sleeve extends in a longitudinal direction and is sleeved at a peripheral side of the connecting sleeve, so that the connecting sleeve can perform reciprocating motion in the longitudinal direction inside the guide sleeve; a bracket is slidingly sleeve at a peripheral side of the scrubbing rod, and the bottom of the bracket is connected to a top end of the guide sleeve; and the spring is arranged inside the guide sleeve, and two ends of the spring in a compression direction thereof abut against the bracket and the first end part, respectively.

20 Claims, 7 Drawing Sheets

CONTAINER WASHING DEVICE

CROSS-REFERENCE TO RELATED APPLICATIONS

The application claims priority to Chinese patent application No. 202420289084.4, filed on Feb. 6, 2024, the entire contents of which are incorporated herein by reference.

TECHNICAL FIELD

The present disclosure relates to the technical field of container washing devices, and in particular to a container washing device for scrubbing a container.

BACKGROUND

The use quantity of cups is large in commercial places such as homes, bars, water bars and restaurants. The cups are usually washed by cup washing devices. Furthermore, with the gradual improvement of living standards, some families usually use similar products to wash cups. Cup containers can only be washed, but cannot be scrubbed. The interior and exterior of the rim of the cup, the inner wall of the cup and the bottom of the cup cannot be scrubbed at the same time. At present, the commercially available cup washing products have poor adaptability to different types of cups, and usually cannot meet the washing operation of cups with different diameters or depths.

SUMMARY

An objective of the present disclosure is to provide a container washing device. A scrubbing rod of the container washing device not only can perform up-and-down telescopic adjustment, but also can rotate. A bracket is further included, so as to adapt to the washing operation of cup containers with various diameters or different depths. An electric driving apparatus is not required, thereby achieving environmental friendliness.

To achieve the above objective, the present disclosure provides the following technical solution:

a first aspect of the present disclosure provides a telescopic adjustment structure of a container washing device. The telescopic adjustment structure of the container washing device includes: a connecting sleeve, a scrubbing rod, a guide sleeve, a bracket and a spring. The connecting sleeve extends in a longitudinal direction, and the top of the connecting sleeve has a first end part; the scrubbing rod is connected to the first end part and extends in the longitudinal direction away from the connecting sleeve, and a first scrubbing piece is arranged at a top side and/or a peripheral side of the scrubbing rod; the guide sleeve extends in a longitudinal direction and is movably sleeved at a peripheral side of the connecting sleeve, so that the connecting sleeve can perform reciprocating motion in the longitudinal direction inside the guide sleeve; a bracket is slidingly sleeve at a peripheral side of the scrubbing rod, and the bottom of the bracket is connected to a top end of the guide sleeve; and the spring is arranged inside the guide sleeve, and two ends of the spring in a compression direction thereof abut against the bracket and the first end part, respectively.

Further, a first spiral protrusion structure extending in the longitudinal direction is arranged at the peripheral side of the connecting sleeve, a first spiral groove matched with the first spiral protrusion structure is formed in an inner wall of the guide sleeve, and the connecting sleeve is slidingly connected to the guide sleeve through the first spiral protrusion structure and the first spiral groove; or a second spiral groove extending in the longitudinal direction is formed in the peripheral side of the connecting sleeve, a second spiral protrusion structure matched with the second spiral groove is arranged on the inner wall of the guide sleeve, and the connecting sleeve is slidingly connected to the guide sleeve through the second spiral groove and the second spiral protrusion structure.

Further, the telescopic adjustment structure of the container washing device further includes a mounting sleeve, the mounting sleeve is sleeved at a peripheral side of the guide sleeve, and a water inlet hole communicating with an interior of the mounting sleeve is formed at the bottom of the mounting sleeve.

Further, a water inlet communicating with an interior of the guide sleeve is formed at the bottom of the guide sleeve; a flow-passing channel is formed inside the connecting sleeve, and a flow-passing hole communicating with the flow-passing channel is formed in a side part of the connecting sleeve; and a pipeline communicating with the flow-passing channel is arranged inside the scrubbing rod, and a water outlet hole communicating with the pipeline is formed in a top side of the scrubbing rod.

Further, the telescopic adjustment structure of the container washing device further includes a water-receiving groove, and the water-receiving groove is sleeved at a peripheral side of the mounting sleeve and located below the bracket.

Further, the water-receiving groove is further connected to a third scrubbing piece, and the third scrubbing piece is configured to scrub a cup container.

Further, the first scrubbing piece is detachably connected or fixedly connected to the scrubbing rod; and the first scrubbing piece and the third scrubbing piece are respectively of a structure formed by one or a combination of more of plastic, silica gel or cotton fiber.

A second aspect of the present disclosure provides a scrubbing rod rotating structure of a container washing device. The scrubbing rod rotating structure of the container washing device includes: a connecting sleeve, a supporting rod, a scrubbing rod, a guide sleeve, a bracket and a spring. The connecting sleeve extends in a longitudinal direction, the top of the connecting sleeve has a first end part, the bottom of the connecting sleeve has a second end part, a flow-passing channel is formed inside the connecting sleeve, a flow-passing hole communicating with the flow-passing channel is formed in a side part of the connecting sleeve, and a peripheral side of the connecting sleeve is provided with an external thread; the supporting rod extends in the longitudinal direction, and a top end of the supporting rod abuts against the second end part to support the connecting sleeve; the scrubbing rod is connected to the first end part and extends in the longitudinal direction away from the connecting sleeve, a first scrubbing piece is arranged at a top side and a peripheral side of the scrubbing rod, a pipeline communicating with the flow-passing channel is arranged inside the scrubbing rod, and a water outlet hole communicating with the pipeline is formed in the top side of the scrubbing rod; the guide sleeve extends in the longitudinal direction and is spirally connected to the peripheral side of the connecting sleeve, and a water inlet communicating with an interior of the guide sleeve is formed at the bottom of the guide sleeve; the bracket is slidingly sleeved at the peripheral side of the scrubbing rod, and the bottom of the bracket is connected to the top end of the guide sleeve; and the spring is arranged inside the guide sleeve, and two ends of the spring in a compression direction thereof abut against the bottom of the bracket and the first end part, respectively.

Further, the inner wall of the guide sleeve is provided with an internal thread matched with the external thread, so that the guide sleeve can be spirally connected to the peripheral side of the connecting sleeve through the internal thread and the external thread.

Further, a first spiral protrusion structure extending in the longitudinal direction is arranged at the peripheral side of the connecting sleeve, a first spiral groove matched with the first spiral protrusion structure is formed in an inner wall of the guide sleeve, and the connecting sleeve is slidingly connected to the guide sleeve through the first spiral protrusion structure and the first spiral groove; or a second spiral groove extending in the longitudinal direction is formed in the peripheral side of the connecting sleeve, a second spiral protrusion structure matched with the second spiral groove is arranged on the inner wall of the guide sleeve, and the connecting sleeve is slidingly connected to the guide sleeve through the second spiral groove and the second spiral protrusion structure.

Further, the scrubbing rod rotating structure of the container washing device further includes a mounting sleeve, the mounting sleeve is sleeved at a peripheral side of the guide sleeve, and a water inlet hole communicating with an interior of the mounting sleeve is formed at the bottom of the mounting sleeve.

water inlet hole communicating with an interior of the mounting sleeve being formed at the bottom of the mounting sleeve a water-receiving groove, and the water-receiving groove is sleeved at a peripheral side of the mounting sleeve and located below the bracket.

Further, the water-receiving groove is further connected to a third scrubbing piece, and the third scrubbing piece is configured to scrub a cup container.

Further, at least one sealing piece is arranged between the peripheral side of the connecting sleeve and the inner wall of the guide sleeve.

Further, the first scrubbing piece is detachably connected to the scrubbing rod; and the first scrubbing piece and the third scrubbing piece are respectively of a structure formed by one or a combination of more of plastic, silica gel or cotton fiber.

A third aspect of the present disclosure provides an apparatus for scrubbing a container port. The apparatus for scrubbing the container port includes a bracket, the bracket is sleeved on a scrubbing rod, and a second scrubbing piece is arranged at the top of the bracket in a direction of a free end thereof.

Further, the apparatus for scrubbing the container port includes a plurality of the brackets, and the plurality of brackets are arranged radially in a same horizontal plane.

Further, a plurality of inserting grooves capable of being inserted into the container port are formed in a top side of the bracket in a direction of a free end thereof, and the second scrubbing piece is arranged in the inserting grooves.

Further, the second scrubbing piece is of a structure formed by one or a combination of more of plastic, silica gel or cotton fiber.

According to the analysis, the present disclosure discloses a telescopic adjustment structure and a scrubbing rod rotating structure of a container washing device, and an apparatus for scrubbing a container port. When a user needs to wash a cup container, a container port of the cup container can be inverted, so that the container port is placed into a container port groove matched with the size of the container port and formed in the apparatus for scrubbing the container port of the container port. The user presses down the container in the longitudinal direction, so that the apparatus for scrubbing the container port of the container port moves downwards. The downward movement of the apparatus for scrubbing the container port of the container port causes the compression of the spring to generate elastic deformation. Under the action of the elastic deformation of the spring and the threaded connection between the guide sleeve and the connecting sleeve, the guide sleeve and the connecting sleeve rotate relatively and move relatively in the longitudinal direction. Finally, the scrubbing rod can penetrate into the container while rotating. A first brush on the scrubbing rod can scrub the inner wall of the cup container and the bottom of the cup while rotating, extending and retracting. The apparatus for scrubbing the container port of the container port can be driven by the guide sleeve to rotate and scrub the container port of the cup container through a second brush at the container port groove. When the cup container is washed, a washing medium can enter the guide sleeve through the water inlet at the bottom of the guide sleeve, then enter the flow-passing channel inside the connecting sleeve through the flow-passing hole formed in the side part of the connecting sleeve, flow into the pipeline inside the scrubbing rod through the flow-passing channel, and finally washes the inner wall of the cup container and the bottom of the cup through the water outlet hole formed in the top side of the scrubbing rod in the rotating, extending and contracting process of the scrubbing rod, thereby washing the cup container. After washing is completed, the user stops pressing down the cup container, and in the process of recovering from the elastic deformation, the spring can drive the apparatus for scrubbing the container port of the container port to reset.

BRIEF DESCRIPTION OF DRAWINGS

The drawings of the specification that constitute a part of the present application are used to provide a further understanding of the present disclosure. The exemplary embodiments of the present disclosure and the description thereof are used to explain the present disclosure, and do not constitute an improper limitation of the present disclosure. In the drawings.

DESCRIPTION OF REFERENCE NUMERALS

Figure 1:
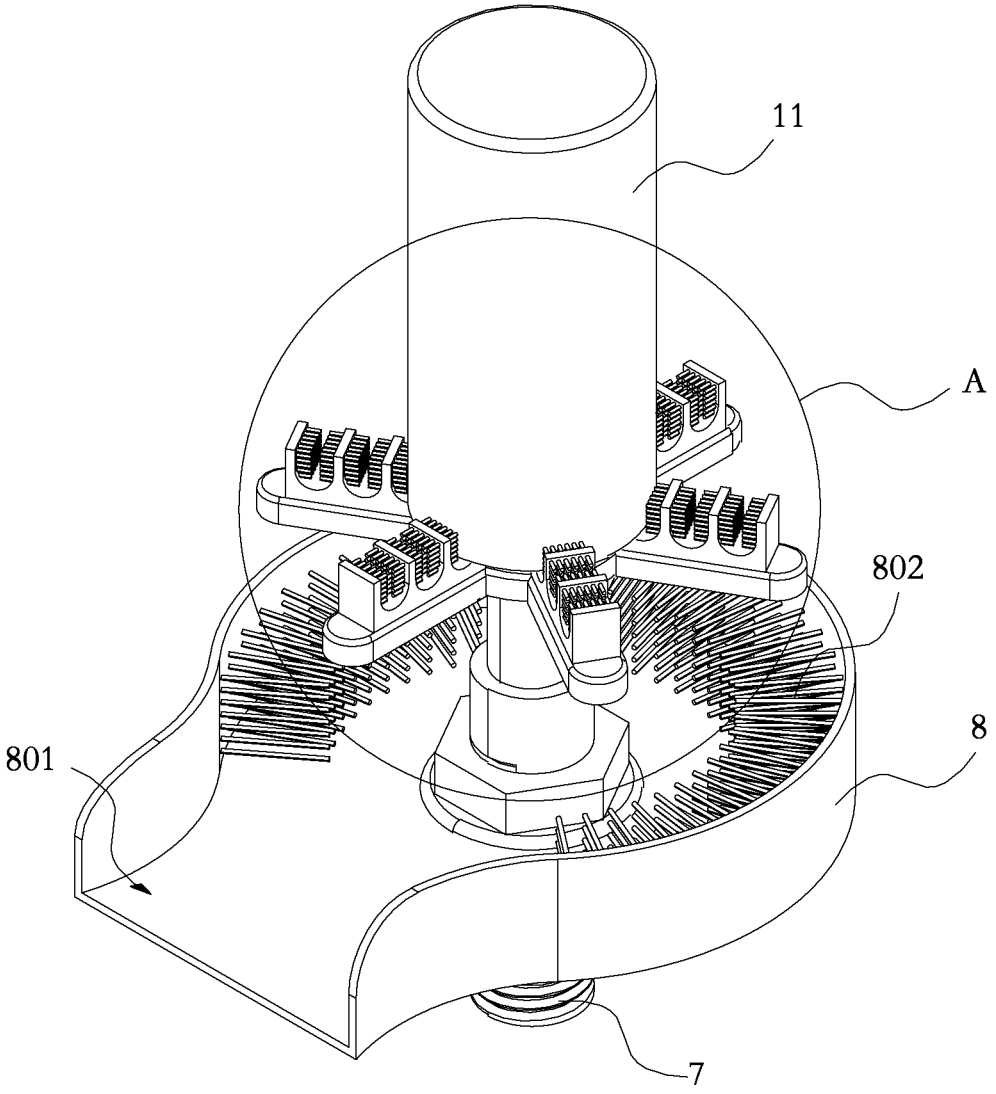
FIG. 1 is a schematic diagram of an axis side structure of a container washing device according to an embodiment of the present disclosure.

1-supporting rod;
2-connecting sleeve; 201-flow-passing channel; 202-flow-passing hole; 203-sealing ring;
3-scrubbing rod; 301-first scrubbing piece; 302-water outlet hole;
4-bracket; 401-inserting groove; 401*a*-second scrubbing piece;
5-guide sleeve; 501-water inlet hole;
6-spring;
7-mounting sleeve; 701-water inlet hole;
8-water-receiving groove; 801-drainage port; 802-third scrubbing piece;
9-first nut; 10-second nut; 11-cup container.

Detailed Description of the Embodiments

The present disclosure will be described in detail below with reference to the accompanying drawings and in conjunction with embodiments. Various examples are provided by way of interpretation of the present disclosure and are not intended to limit the present disclosure. Indeed, it will be apparent to those skilled in the art that modifications and variations may be made in the present disclosure without departing from the scope or spirit of the present disclosure. For example, features shown or described as part of one embodiment may be used in another embodiment to produce yet another embodiment. Therefore, it is desirable that the present disclosure includes such modifications and variations falling within the scope of the appended claims and their equivalents.

In the description of the present disclosure, the terms "longitudinal", "transverse", "up", "down", "front", "back", "left", "right", "vertical", "horizontal", "top", "bottom" and the like denote orientation or positional relationships based on those shown in the drawings and are intended for ease of description only and not to require that the present disclosure is necessarily constructed and operated in a particular orientation and thus cannot be construed as a limitation to the present disclosure. The terms "connection", "connect" and "set" used in the present disclosure should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present disclosure are shown in the accompanying drawings. The detailed description uses numeric and letter marks to refer to features in the drawings. Similar or like reference signs in the drawings and descriptions have been used to refer to similar or like parts of the present disclosure. As used herein, the terms "first", "second" and "third" and the like are used interchangeably to distinguish one member from another and are not intended to denote the location or importance of individual members.

Figure 2:
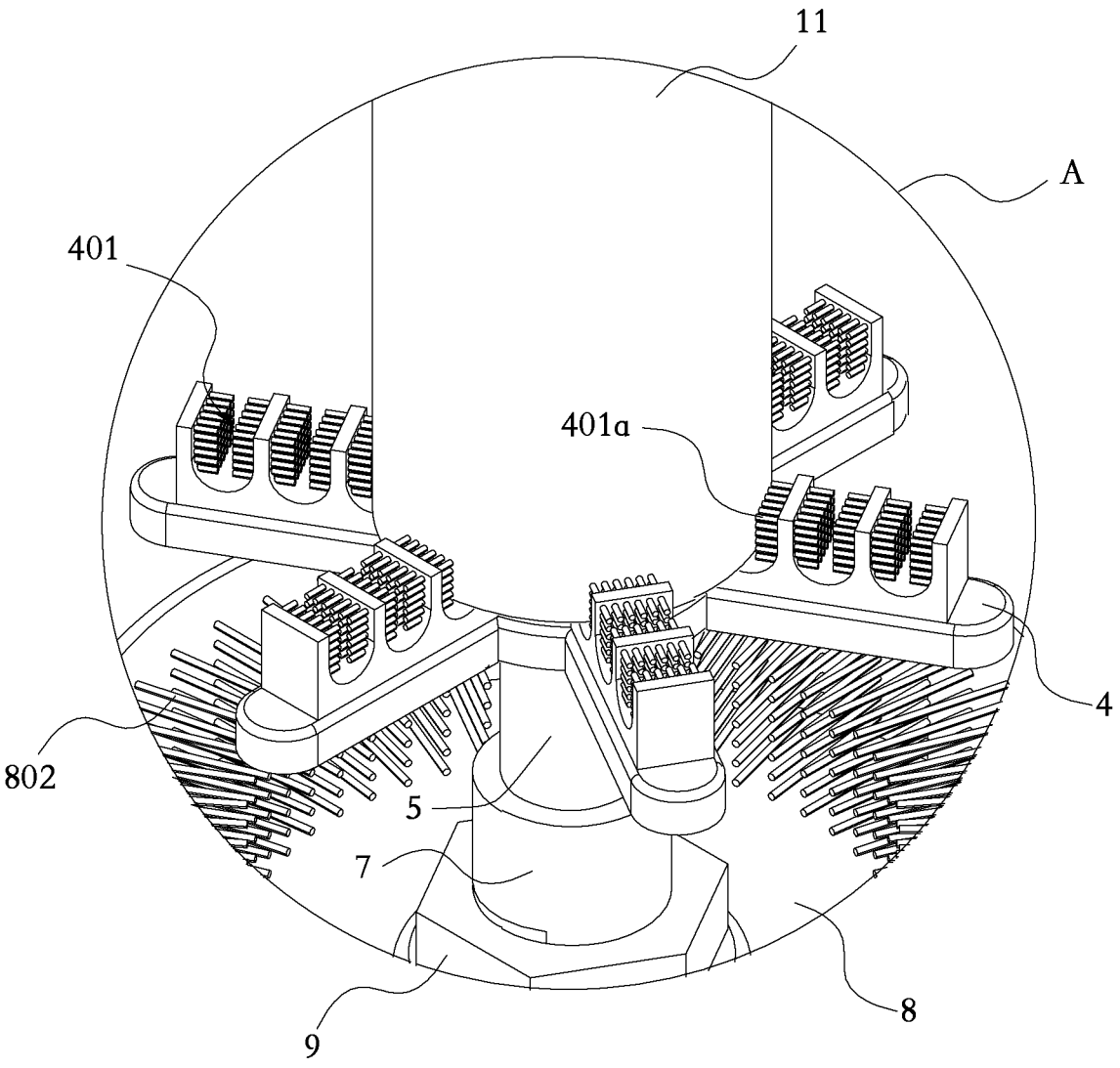
FIG. 2 is a schematic diagram of a locally enlarged structure of a part A in FIG. 1.
Figure 3:
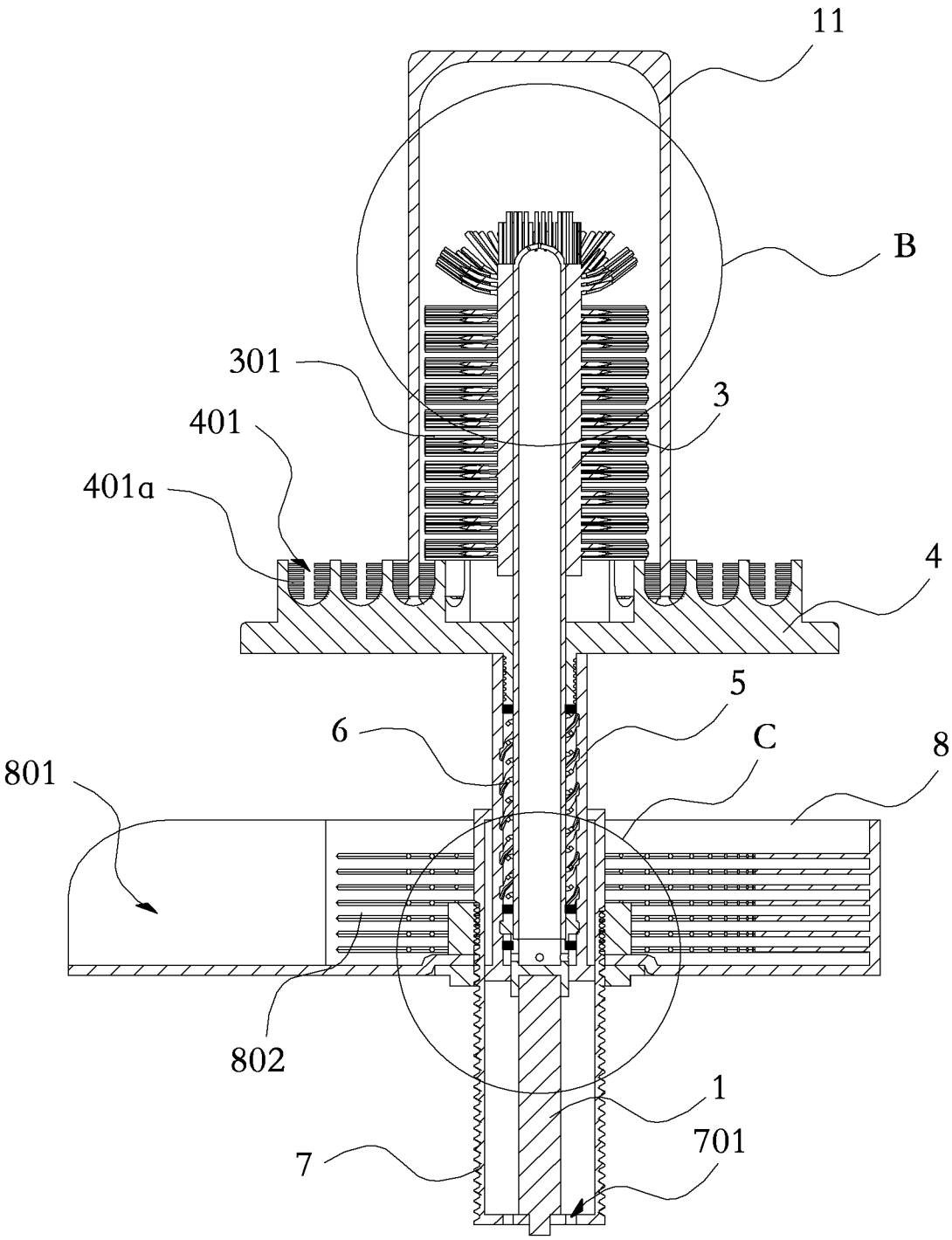
FIG. 3 is a schematic diagram of a sectional structure of a container washing device according to an embodiment of the present disclosure.
Figure 4:
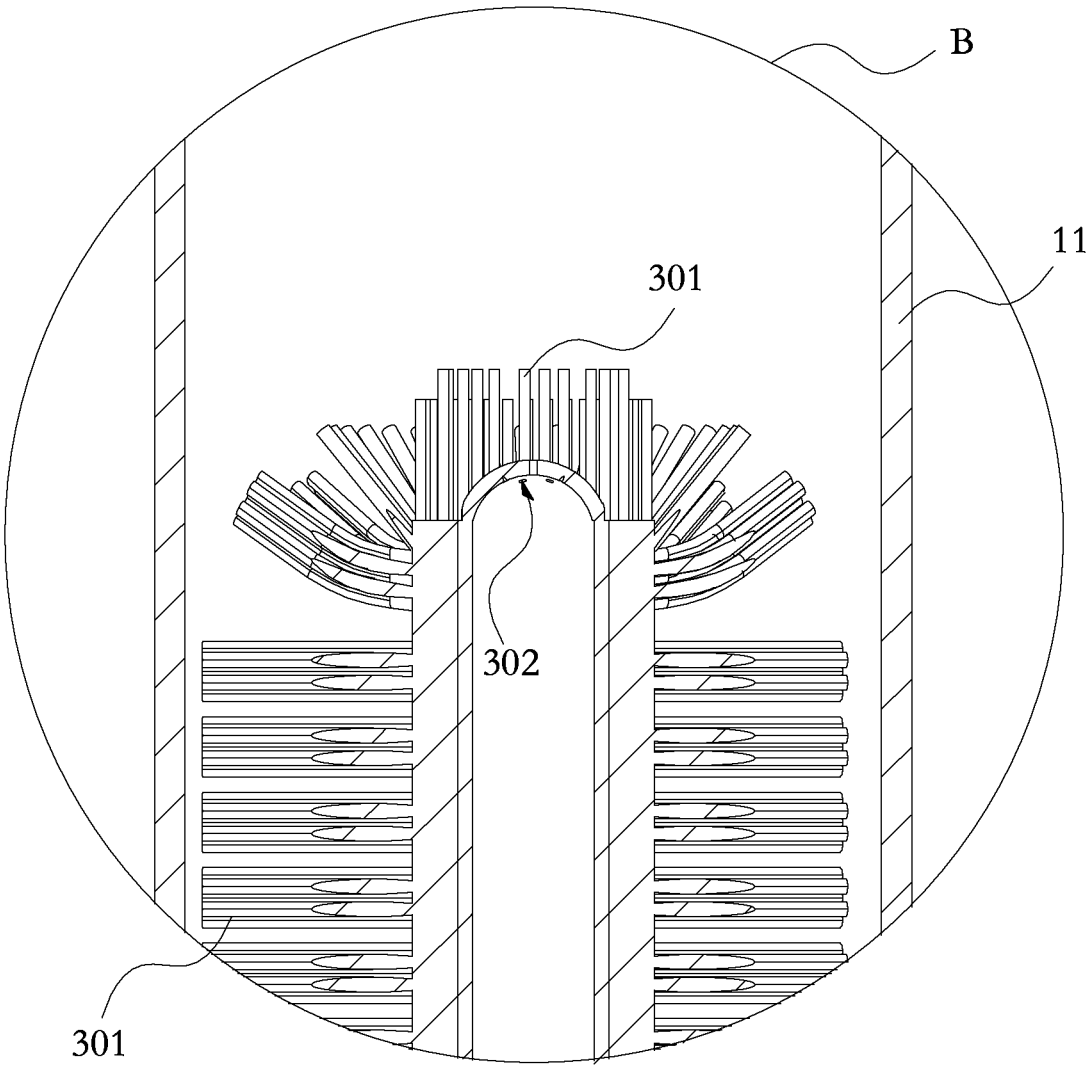
FIG. 4 is a schematic diagram of a locally enlarged structure of a part B in FIG. 3.
Figure 5:
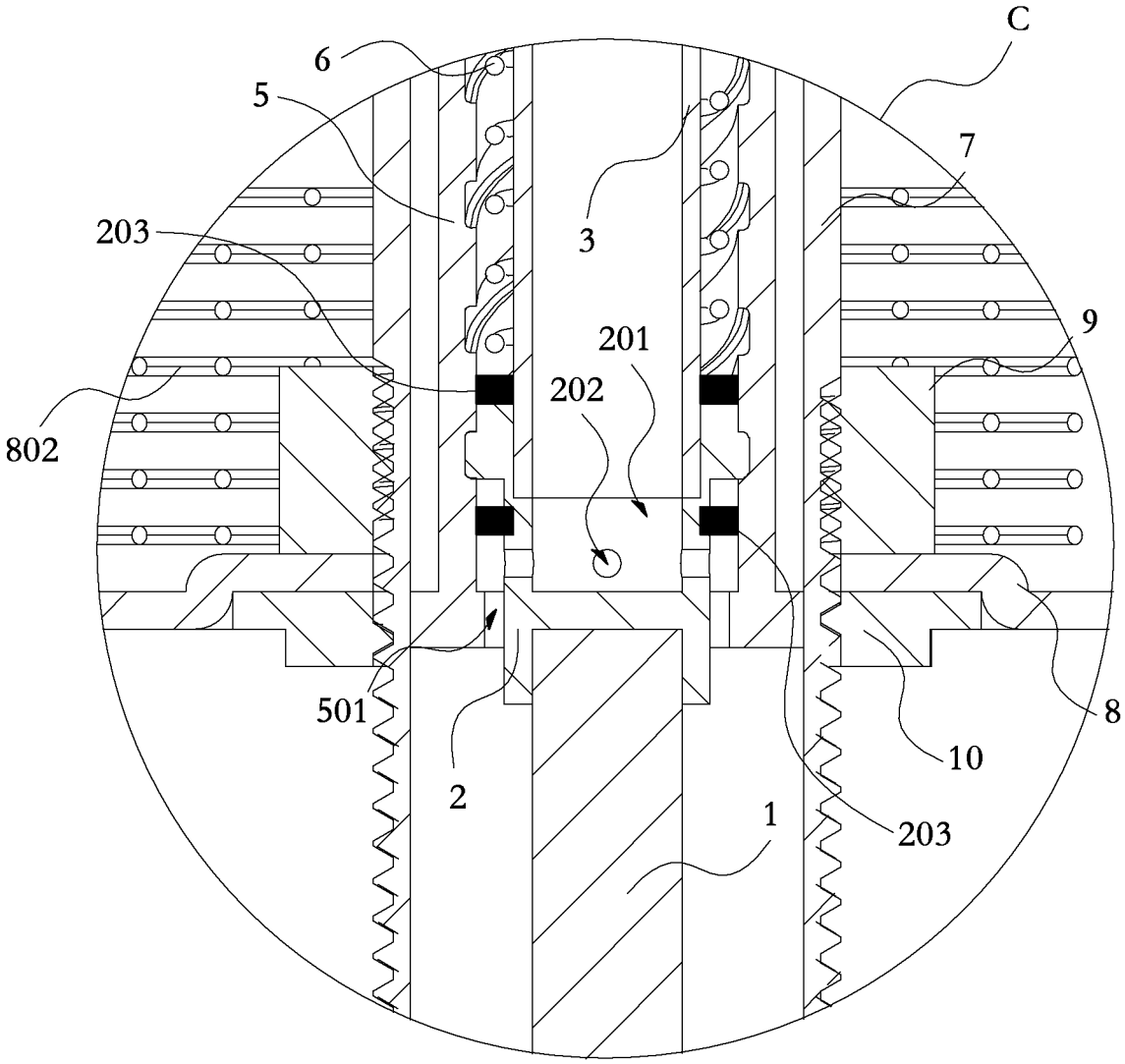
FIG. 5 is a schematic diagram of a locally enlarged structure of a part C in FIG. 3.
Figure 6:
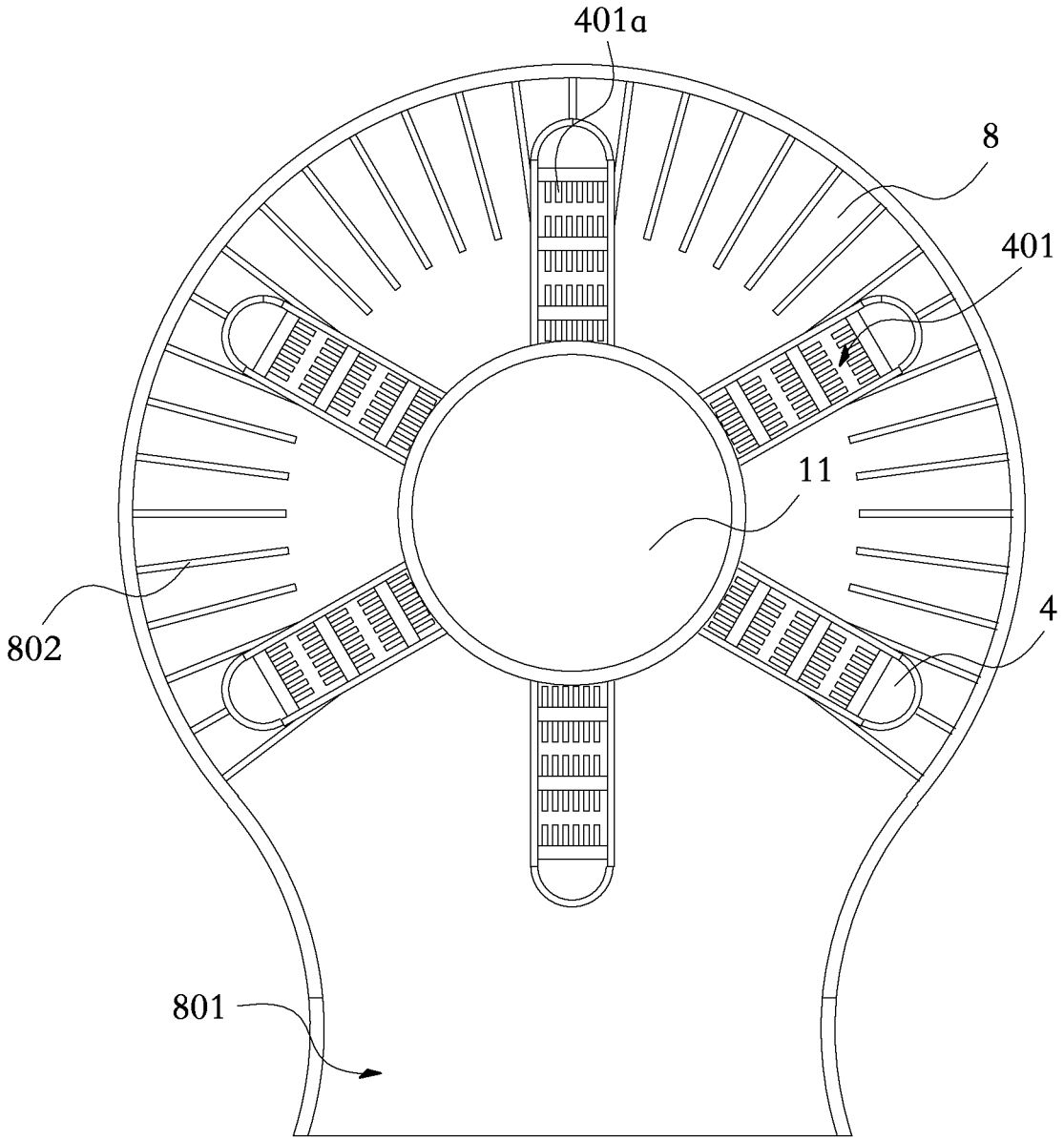
FIG. 6 is a schematic diagram of a top-view structure of a container washing device according to an embodiment of the present disclosure.
Figure 7:
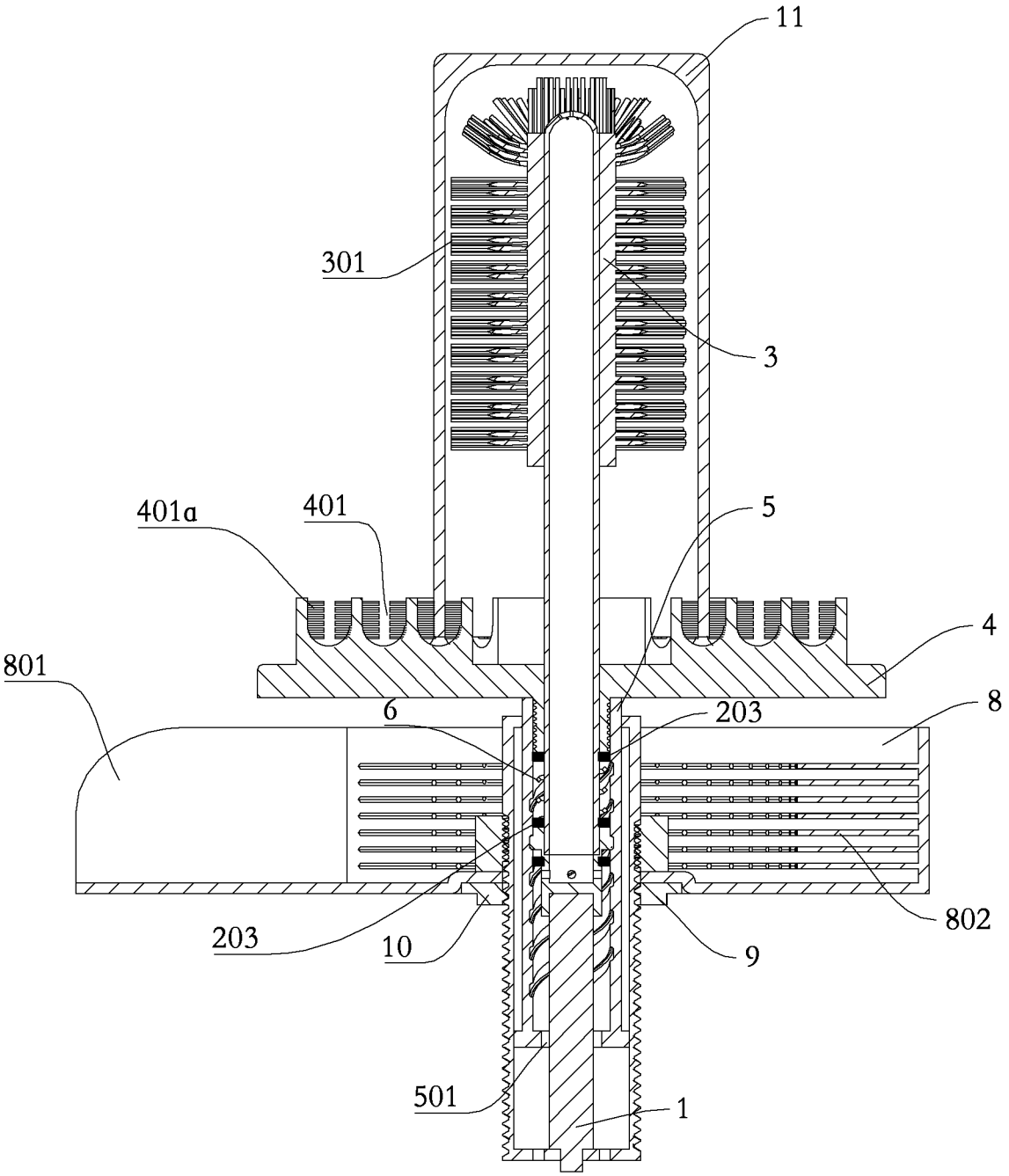
FIG. 7 is a schematic diagram of a sectional structure of a container washing device according to an embodiment of the present disclosure in a working state.

As shown in FIG. 1 to FIG. 7, embodiments of the present disclosure provide a container washing device in combination with a telescopic adjustment structure of a container washing device according to a first aspect of the present disclosure, a scrubbing rod rotating structure of a container washing device according to a second aspect of the present disclosure and an apparatus for scrubbing a container port according to a third aspect of the present disclosure.

Specifically, the container washing device includes a supporting rod 1, a connecting sleeve 2, a scrubbing rod 3, a cup holder, a guide sleeve 5, a spring 6, a mounting sleeve 7 and a water-receiving groove 8. The connecting sleeve 2 extends in a longitudinal direction, and has a first end part and a second end part sequentially from top to bottom in the longitudinal direction. The scrubbing rod 3 is connected to the first end part and extends in the longitudinal direction away from the connecting sleeve 2, the supporting rod 1 extends in the longitudinal direction, and the top end of the supporting rod abuts against the second end part to support the connecting sleeve 2. A first spiral protrusion structure extending in the longitudinal direction is arranged at a peripheral side of the connecting sleeve 2, a first spiral groove matched with the first spiral protrusion structure is formed in an inner wall of the guide sleeve 5, and the connecting sleeve 2 is slidingly connected to the guide sleeve 5 through the first spiral protrusion structure and the first spiral groove. The apparatus for scrubbing the container port is slidingly sleeved at a peripheral side of the scrubbing rod 3, and the bottom of the apparatus for scrubbing the container port is connected to the top end of the guide sleeve 5. The spring 6 is arranged inside the guide sleeve 5, and two ends of the spring in a compression direction thereof abut against the bottom of a cup holder and the first end part, respectively. The mounting sleeve 7 is sleeved at the peripheral side of the guide sleeve 5, a peripheral side of the mounting sleeve 7 is provided with a mounting thread; the water-receiving groove 8 is spirally connected to the mounting thread at the peripheral side of the mounting sleeve 7 through a first nut 9 and a second nut 10, and is located below the cup holder; and a groove wall of the water-receiving groove 8 is connected to a third scrubbing piece 802.

Preferably, a plurality of water inlet holes 701 capable of communicating a pressure source are formed at the bottom of the mounting sleeve 7, so that a washing medium provided by the pressure source can enter the mounting sleeve 7 through the water inlet hole 701. A through hole is formed at the bottom of the guide sleeve 5, and a size of the through hole is greater than outer diameters of the supporting rod 1 and the connecting sleeve 2, so that a gap is present between the through hole, the supporting rod 1 and the connecting sleeve 2, a water inlet 501 is formed, and a washing medium inside the mounting sleeve 7 can enter the guide sleeve 5 through the water inlet 501. A flow-passing channel 201 is formed inside the connecting sleeve 2, and a plurality of flow-passing holes 202 communicating with the flow-passing channel 201 are formed in a side part of the connecting sleeve 2, so that a washing medium inside the guide sleeve 5 can enter the flow-passing channel 201 through the flow-passing holes 202. A pipeline communicating with the flow-passing channel 201 is formed inside the scrubbing rod 3, and a plurality of water outlet holes 302 communicating with the pipeline are formed in a top side of the scrubbing rod 3, so that a washing medium in the flow-passing channel 201 can enter the pipeline inside the scrubbing rod 3 and finally can flow out of the plurality of water outlet holes 302 in the top side of the scrubbing rod 3, thereby washing the inner wall of the cup container 11 and the bottom of the cup.

Preferably, a sealing ring 203 is respectively sleeved at the peripheral side and the top side of the connecting sleeve 2, and the sealing ring 203 can seal a gap at a position where the connecting sleeve 2 and the guide sleeve 5 are in threaded engagement, thereby preventing the washing medium from leaking from the threaded engagement gap.

Preferably, the apparatus for washing the container port has six brackets 4 arranged radially around the scrubbing rod 3; any two adjacent brackets 4 have a 60-degree included angle; three inserting grooves 401 are formed in each of the brackets 4 in a radial direction thereof to adapt to at least three cup containers 11 with different container port sizes; and approximately three concentric ring grooves are formed radially among the inserting grooves 401 of the six brackets 4, and the three concentric ring grooves can be configured to accommodate at least three container ports with different diameters.

Preferably, first scrubbing pieces 301 are arranged at the top side and the peripheral side of the scrubbing rod 3, second scrubbing pieces 401*a* are arranged in the inserting grooves 401, and a third scrubbing piece 802 is arranged on the inner wall of the water-receiving groove 8. The first scrubbing pieces 301, the second scrubbing pieces 401*a* and the third scrubbing piece 802 may adopt one or a combination of more of plastic, silica gel or cotton fiber to form a bunched structure or a strip block-shaped structure. Specifically, the first scrubbing pieces 301, the second scrubbing pieces 401*a* and the third scrubbing piece 802 may be made of a food-grade PP material.

Preferably, the water-receiving groove 8 may be formed by an engineering plastic material through injection molding or be formed by a metal material through a sheet metal process; and the water-receiving groove 8 is located below the cup holder to bear the washing medium after washing.

Preferably, a drainage port 801 may be formed in one side of the water-receiving groove 8 and is configured to discharge a washing medium borne therein.

From the above description, it can be seen that the above embodiment of the present disclosure achieves the following technical effects:

Compared with the prior art, when the container washing device provided by the embodiments of the present disclosure is used, the user can invert the container port of the cup container 11, so that the container port is placed in the inserting groove 401 matched with the size of the container port and formed in the apparatus for scrubbing the container port. The user presses down the cup container 11 in the longitudinal direction, so that the apparatus for scrubbing the container port moves downwards. The downward movement of the apparatus for scrubbing the container port causes the compression of the spring 6 to generate elastic deformation. Under the action of the elastic deformation of the spring 6 and the sliding connection between the guide sleeve 5 and the connecting sleeve 2, the guide sleeve 5 and the connecting sleeve 2 rotate relatively and move relatively in the longitudinal direction. Finally, the scrubbing rod 3 can penetrate into the cup container 11 while rotating. The first scrubbing piece 301 on the scrubbing rod 3 can scrub the inner wall of the cup container 11 and the bottom of the cup while rotating, extending and contracting. The bracket 4 in the apparatus for scrubbing the container port can be driven by the guide sleeve 5 to rotate and wash the container port of the cup container 11 through the second scrubbing piece 401*a* at the inserting groove 401. When the apparatus for washing the container port moves into the water-receiving groove 8, the third scrubbing piece 802 arranged on the inner wall of the water-receiving groove 8 can scrub an outer wall of the cup container 11 when the bracket rotates. When the cup container 11 is washed, a washing medium can enter the guide sleeve 5 through the water inlet 501 at the bottom of the guide sleeve 5, then enters the flow-passing channel 201 inside the connecting sleeve 2 through the flow-passing hole 202 formed in the side part of the connecting sleeve 2, flows into the pipeline inside the scrubbing rod 3 through the flow-passing channel 201, and finally washes the inner wall of the cup container 11 and the bottom of the cup through the water outlet hole 302 formed in the top side of the scrubbing rod 3 in the rotating, extending and contracting process of the scrubbing rod 3, thereby washing the cup container 11. After washing is completed, the user stops pressing down the cup container 11, and in the process of recovering from the elastic deformation, the spring 6 can drive the apparatus for scrubbing the container port of the container port to reset.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. A telescopic adjustment structure of a container washing device, comprising:

a connecting sleeve, extending in a longitudinal direction, wherein a top of the connecting sleeve has a first end part;

a scrubbing rod, connected to the first end part and extending in a longitudinal direction away from the connecting sleeve, wherein a first scrubbing piece is arranged at a top side and/or a peripheral side of the scrubbing rod;

a guide sleeve, extending in the longitudinal direction and movably sleeved at a peripheral side of the connecting sleeve, so that the connecting sleeve is capable of performing reciprocating motion in the longitudinal direction inside the guide sleeve;

a bracket, slidingly sleeved at a peripheral side of the scrubbing rod, wherein a bottom of the bracket is connected to a top end of the guide sleeve; and a spring, arranged inside the guide sleeve, wherein two ends of the spring in a compression direction thereof abut against the bracket and the first end part, respectively.

2. The telescopic adjustment structure of a container washing device according to claim 1, wherein a first spiral protrusion structure extending in the longitudinal direction is arranged at the peripheral side of the connecting sleeve, a first spiral groove matched with the first spiral protrusion structure is formed in an inner wall of the guide sleeve, and the connecting sleeve is slidingly connected to the guide sleeve through the first spiral protrusion structure and the first spiral groove; or a second spiral groove extending in the longitudinal direction is formed in the peripheral side of the connecting sleeve, a second spiral protrusion structure matched with the second spiral groove is arranged on the inner wall of the guide sleeve, and the connecting sleeve is slidingly connected to the guide sleeve through the second spiral groove and the second spiral protrusion structure.

3. The telescopic adjustment structure of a container washing device according to claim 1, further comprising:

a mounting sleeve, sleeved at a peripheral side of the guide sleeve, wherein a water inlet hole communicating with an interior of the mounting sleeve is formed at a bottom of the mounting sleeve.

4. The telescopic adjustment structure of a container washing device according to claim 3, wherein a water inlet communicating with an interior of the guide sleeve is formed at a bottom of the guide sleeve;

a flow-passing channel is formed inside the connecting sleeve, and a flow-passing hole communicating with the flow-passing channel is formed in a side part of the connecting sleeve; and a pipeline communicating with the flow-passing channel is arranged inside the scrubbing rod, and a water outlet hole communicating with the pipeline is formed in a top side of the scrubbing rod.

5. The telescopic adjustment structure of a container washing device according to claim 4, further comprising:

a water-receiving groove, sleeved at a peripheral side of the mounting sleeve and located below the bracket.

6. The telescopic adjustment structure of a container washing device according to claim 5, wherein the water-receiving groove is further connected to a third scrubbing piece, and the third scrubbing piece is configured to scrub a cup container.

7. The telescopic adjustment structure of a container washing device according to claim 6, wherein the first scrubbing piece is detachably connected or fixedly connected to the scrubbing rod; and the first scrubbing piece and the third scrubbing piece are respectively of a structure formed by one or a combination of more of plastic, silica gel, nylon or cotton fiber.

8. A scrubbing rod rotating structure of a container washing device, comprising:

a connecting sleeve, extending in a longitudinal direction, wherein a top of the connecting sleeve has a first end part, a bottom of the connecting sleeve has a second end part, a flow-passing channel is formed inside the connecting sleeve, a flow-passing hole communicating with the flow-passing channel is formed in a side part of the connecting sleeve, and a threaded structure is arranged at a peripheral side of the connecting sleeve;

a supporting rod, extending in the longitudinal direction, wherein a top end of the supporting rod abuts against the second end part to support the connecting sleeve;

a scrubbing rod, connected to the first end part and extending in the longitudinal direction away from the connecting sleeve, wherein the scrubbing rod is provided with a first scrubbing piece, a pipeline communicating with the flow-passing channel is arranged inside the scrubbing rod, and a water outlet hole communicating with the pipeline is formed in a top side of the scrubbing rod;

a guide sleeve, extending in the longitudinal direction and spirally connected to the connecting sleeve, wherein a water inlet communicating with an interior of the guide sleeve is formed at a bottom of the guide sleeve;

a bracket, slidingly sleeved at a peripheral side of the scrubbing rod, wherein a bottom of the bracket is connected to a top end of the guide sleeve; and a spring, arranged inside the guide sleeve, wherein two ends of the spring in a compression direction thereof abut against the bracket and the first end part, respectively.

9. The scrubbing rod rotating structure of a container washing device according to claim 8, wherein a corresponding threaded structure matched with the threaded structure of the connecting sleeve is arranged on an inner wall of the guide sleeve, so that the guide sleeve is capable of being spirally connected to the peripheral side of the connecting sleeve through the threaded structure in a matching manner.

10. The scrubbing rod rotating structure of a container washing device according to claim 9, further comprising:

a mounting sleeve, sleeved at a peripheral side of the guide sleeve, wherein a water inlet hole communicating with an interior of the mounting sleeve is formed at a bottom of the mounting sleeve.

11. The scrubbing rod rotating structure of a container washing device according to claim 10, further comprising:

a water-receiving groove, sleeved at a peripheral side of the mounting sleeve and located below the bracket.

12. The scrubbing rod rotating structure of a container washing device according to claim 11, wherein the water-receiving groove is further connected to a third scrubbing piece, and the third scrubbing piece is configured to scrub a cup container.

13. The scrubbing rod rotating structure of a container washing device according to claim 12, the first scrubbing piece and the third scrubbing piece are respectively of a structure formed by one or a combination of more of nylon, plastic, silica gel or cotton fiber.

14. The scrubbing rod rotating structure of a container washing device according to claim 9, at least one sealing piece is arranged between the peripheral side of the connecting sleeve and the inner wall of the guide sleeve.

15. The scrubbing rod rotating structure of a container washing device according to claim 8, wherein a first spiral protrusion structure extending in the longitudinal direction is arranged at the peripheral side of the connecting sleeve, a first spiral groove matched with the first spiral protrusion structure is formed in an inner wall of the guide sleeve, and the connecting sleeve is slidingly connected to the guide sleeve through the first spiral protrusion structure and the first spiral groove; or a second spiral groove extending in the longitudinal direction is formed in the peripheral side of the connecting sleeve, a second spiral protrusion structure matched with the second spiral groove is arranged on the inner wall of the guide sleeve, and the connecting sleeve is slidingly connected to the guide sleeve through the second spiral groove and the second spiral protrusion structure.

16. The scrubbing rod rotating structure of a container washing device according to claim 8, wherein the first scrubbing piece is detachably connected or fixedly connected to the scrubbing rod, and the first scrubbing piece is arranged at the top side and/or the peripheral side of the scrubbing rod, respectively.

17. An apparatus for scrubbing a container port, comprising:

a connecting sleeve, wherein a flow-passing channel is formed inside the connecting sleeve, and a flow-passing hole communicating with the flow-passing channel is formed inside the connecting sleeve;

a scrubbing rod, connected to the connecting sleeve, wherein a pipeline communicating with the flow-passing channel is arranged inside the scrubbing rod, and a water outlet hole communicating with the pipeline is formed in a top side of the scrubbing rod;

a bracket, arranged on the scrubbing rod, wherein a second scrubbing piece is arranged at a top of the bracket;

a water-receiving groove, connected to the scrubbing rod, wherein the water-receiving groove is further connected to a third scrubbing piece.

18. The apparatus for scrubbing a container port according to claim 17, comprising a plurality of the brackets, wherein the plurality of brackets are arranged radially in a same horizontal plane; and a first scrubbing piece is arranged at a top side and/or a peripheral side of the scrubbing rod.

19. The apparatus for scrubbing a container port according to claim 17, wherein a plurality of inserting grooves capable of being inserted into the container port are formed in a top side of the bracket in a direction of a free end thereof, and the second scrubbing piece is arranged in the inserting grooves; and the water-receiving groove is further connected to a third scrubbing piece.

20. The apparatus for scrubbing a container port according to claim 17, wherein the second scrubbing piece is of a structure formed by one or a combination of more of nylon, plastic, silica gel or cotton fiber.

* * * * *